US005617682A

United States Patent [19]

Christopher

[11] Patent Number: 5,617,682

[45] Date of Patent: Apr. 8, 1997

[54] INSULATED SKYLIGHT PANEL

[75] Inventor: Michael E. Christopher, Houston, Tex.

[73] Assignee: Texas Aluminum Industries, Inc., Houston, Tex.

[21] Appl. No.: 474,514

[22] Filed: Jun. 7, 1995

[51] Int. Cl.[6] ..... E04B 7/18

[52] U.S. Cl. ..... 52/200; 52/90.1; 52/656.5; 52/762; 52/780

[58] Field of Search ..... 52/90.1, 200, 202, 52/204.1, 204.69, 208, 455, 656.5, 656.6, 762, 764, 766, 769, 775, 780, 781

[56] References Cited

U.S. PATENT DOCUMENTS

| | | | |
|---|---|---|---|
| 3,881,287 | 5/1975 | Biebuyck | 52/775 X |
| 3,958,383 | 5/1976 | Dallen | 52/208 X |
| 4,625,479 | 12/1986 | Giguere | 52/202 |
| 4,648,231 | 3/1987 | Laroche | 52/775 |
| 4,686,805 | 8/1987 | Forslin | 52/208 |
| 4,787,184 | 11/1988 | Boidron | 52/208 X |
| 5,090,164 | 2/1992 | Mische | 52/90.1 |
| 5,107,647 | 11/1992 | Danielewicz | 52/775 X |
| 5,293,728 | 3/1994 | Christopher et al. . | |
| 5,394,664 | 3/1995 | Nowell | 52/200 |
| 5,410,849 | 5/1995 | Christopher . | |

FOREIGN PATENT DOCUMENTS

| | | | |
|---|---|---|---|
| WO92/01122 | 1/1992 | WIPO | 52/200 |

*Primary Examiner*—Carl D. Friedman
*Assistant Examiner*—Kevin D. Wilkens
*Attorney, Agent, or Firm*—Pravel, Hewitt, Kimball & Krieger

[57] ABSTRACT

A skylight panel has a first skylight frame adapted to be adjacently positioned to the first building panel. The first skylight frame includes an upper and a lower first connector respectively coupled to the top of the first skylight frame and the bottom of the first skylight frame. The upper and lower first connectors are adapted to be coupled to the upper and lower connectors of the first building panel. A first lower flange is mounted to the first skylight frame for supporting one side of the radiation attenuating member. The skylight panel also includes a second skylight frame adapted to be adjacently positioned to the second building panel. The second skylight frame includes an upper and a lower second connector respectively coupled to the top of the second skylight frame and the bottom of said second skylight frame. The upper and lower second connectors are adapted to be coupled to the upper and lower connectors of the second building panel. The second skylight frame also includes a second lower flange mounted to the second skylight frame which cooperates with the first lower flange to support the radiation attenuating member. In another embodiment, a pair of upper flanges is connected in a similar fashion to the lower flanges to provide support for another radiation attenuating member.

20 Claims, 3 Drawing Sheets

INSULATED SKYLIGHT PANEL

BACKGROUND OF THE INVENTION

1. Field of the Invention

The present invention relates to modular building panels, and more particularly to such panels for the construction of a skylight.

2. Description of the Related Art

The development of modular building panels for the modular construction of walls, ceilings, or the like has enabled builders to assemble highly functional structures relatively quickly and economically. U.S. Pat. No. 5,410,849, issued to Michael E. Christopher, and herein incorporated by reference, discloses a modular building panel having a connector interlock mechanism for connecting building panels in series. As disclosed in Christopher, a plurality of panels is interlocked together in edge-to-edge connections to form a ceiling, wall, etc. The panels so connected can be quickly disconnected by pulling the panels apart and releasing the edge connection. In addition to the ease of assembly, the interlock mechanism disclosed in Christopher provides multiple flow channels or grooves to direct rainfall and moisture or water leakage outwardly from the panels. The interlock mechanism further provides an insulated structure to avoid the condensation of moisture on the interior of the panel skin. In addition, the panel provides a core material to insulate the interior structure from outside temperature extremes. Thus, a structure constructed using the modular insulated building panels disclosed in Christopher, requires less labor to assemble, no exterior fasteners, and provides a complete shield from all elements.

Although a complete isolation from the elements is desirable in many situations, the availability of natural light is at times desirable because natural light can contribute greatly to the brightness and decor of a building or a walkway. Traditionally, a conventional skylight is provided on a roof to let in light while keeping out the remaining elements. However, the construction of the conventional roof top skylight creates a number of problems. Typically, the installation of a skylight requires that the integrity of the roof panel be breached in a plurality of locations. The first breach provides an opening to admit light, which is likely to be several square feet in area. This opening will have a perimeter several feet long, all of which must be made water tight. The breaching of parts of the modular building panel disclosed in Christopher is undesirable as the strength and integrity of the edge-to-edge connector interlock mechanism can be undermined.

The creation of the opening also disrupts the structural integrity, moisture, or element control, as well as the insulated structure which prevents condensation. Furthermore, nails, screws, or other common fasteners used to hold components of a conventional skylight system to the roof panel create additional potential leakage sites. Additionally, it is difficult to form a watertight seal between a radiation attenuating member, which typically is composed of an acrylic or a translucent glass panel, and a metal or a shingled roof underneath it due in part to the difference between the expansion coefficients of the unrelated materials. Thus, large amounts of sealant are needed, but do not ensure a completely water tight system.

Another method for avoiding the necessity of such a seal involves the construction of a structure known as a curb. A curb is a raised platform which surrounds the opening on the roof. It is made from a number of materials, including wood, which can be readily affixed to the roof using traditional roofing techniques. The radiation attenuating member such as an acrylic or a tinted glass pane can then be attached to the top of the curb. Less effort is required to attach the radiation attenuating member to the curb because the curb can be readily modified to fit against the radiation attenuating member. Furthermore, the curb moves the seal, traditionally placed under the radiation attenuating member, to a point above the level of flowing water draining off of the roof.

Although curbed systems alleviate the water leakage problem, the use of curbs introduces other negative aspects. Curbs are often the most expensive part of the skylight assembly, as using skilled labor at a job site to cut holes and build curbs often costs substantially more than the radiation attenuating member itself.

Furthermore, curbs are heavy and often require that additional support be provided in the area around the skylight. The construction of the seal between the curb and the roof requires time, skill, and a large amount of sealant. If the installer is not careful, leaks may develop which will be costly and difficult to repair subsequently. Further, the curb results in a raised profile which may be aesthetically and aerodynamically undesirable. As the above mentioned problems are at odds with the purpose and intent behind the modular building panel concept, a need exists for modular building panels capable of providing for a skylight while retaining the advantages of the modular building panel concept.

In addition, although the skylight can contribute to the brightness and decor of structures covered by the skylight, the use of the skylight introduces another problem that needs to be rectified. Particularly when the sun is directly overhead, a conventional single-paned skylight can still relay undesirable heat, glare, and ultraviolet radiation to the occupants. During the summer months and in Sun-Belt locations, the extra heat, glare, and ultraviolet rays can be quite discomforting and can cause premature fading or deterioration of the carpet and articles under the skylight. As the heat and glare passing through the skylight can be quite annoying, a need exists for a skylight that can pass the natural light without the accompanying heat and glare.

In the instant invention, the above-mentioned problems have been overcome by skylight frames that can interlock with the insulated building panels and provide support for single or multiple radiation attenuating members to allow light to pass through while insulating the user from the resultant heat, glare and ultraviolet rays. The skylight frames can be snap-fitted with the building panels and thus require little labor to assemble. Furthermore, because channels are provided to drain water away from the skylight frames, leakage is no longer a problem. Thus, the instant invention provides the benefits of a skylight in addition to the advantages and qualities of the modular building panels.

These and other objects and advantages of the invention will become apparent from the following description.

SUMMARY OF THE INVENTION

The present invention provides a skylight panel for suspending a radiation attenuating member between a first building panel and a second building panel which are mounted substantially planar to each other and spaced apart. The first building panel has an upper and a lower connector projecting from one side of the first building panel. Similarly, the second building panel has an upper and a lower connector extending from the second building panel toward the first side of the first building panel.

The skylight panel of the invention has a first skylight frame adapted to be adjacently positioned to the first building panel. The first skylight frame includes an upper and a lower first connector respectively coupled to the top of the first skylight frame and the bottom of the first skylight frame. The upper and lower first connectors are adapted to be coupled to the upper and lower connectors of the first building panel. A first lower flange is mounted to the first skylight frame for supporting one side of the radiation attenuating member.

The skylight panel also includes a second skylight frame adapted to be adjacently positioned to the second building panel. The second skylight frame includes an upper and a lower second connector respectively coupled to the top of the second skylight frame and the bottom of said second skylight frame. The upper and lower second connectors are adapted to be coupled to the upper and lower connectors of the second building panel. The second skylight frame also includes a second lower flange mounted to the second skylight frame which cooperates with the first lower flange to support the radiation attenuating member. In another embodiment, a pair of upper flanges is connected in a similar fashion to the lower flanges to provide support for another radiation attenuating member.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1:
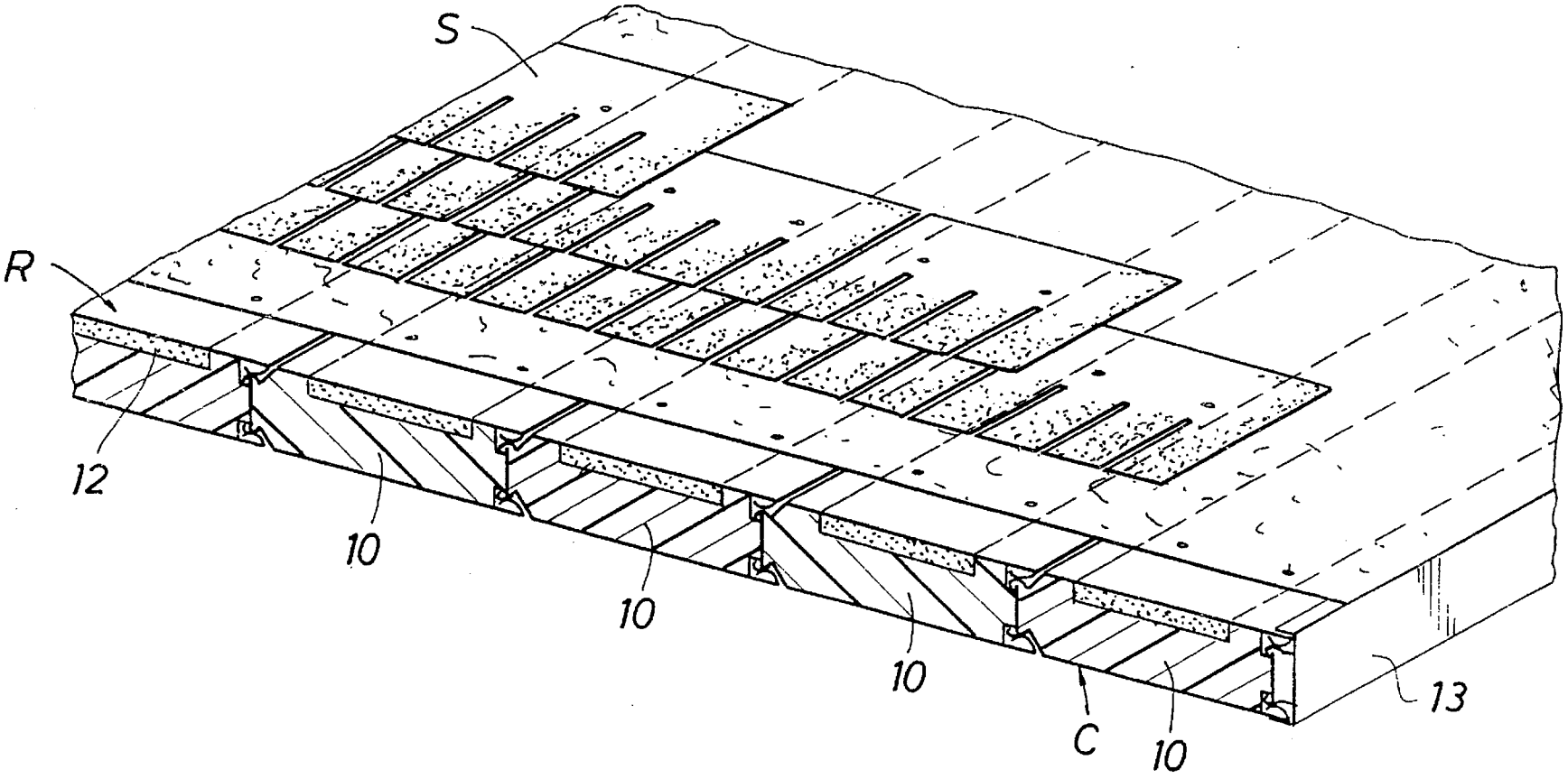
FIG. 1 (PRIOR ART)
FIG. 1 is a perspective view of the prior art panels interlocked together in edge-to-edge connections to form a ceiling.

Turning now to the drawings, FIG. 1 illustrates an insulating building panel in the prior art. As shown in FIG. 1, a series of panels 10 are connected to each other by an interlock mechanism. Each panel has a construction material 12 centrally positioned under the roof R for accepting roof shingles S. Roofing shingles S are shown attached to a roof R. A side receiver channel 13 and side and/or receiver channels (not shown but well known in the art) are nailed or screwed to the overhead beams of a building such that the combined panels form a roof R and a ceiling C. The insulated building panel has two metal sheets (or skins) forming the connector structures separated by an insulating foam core. Panels 10 are of a length and width as required for each specific construction requirement, but typically the length far exceeds the width of a panel.

Figure 2:
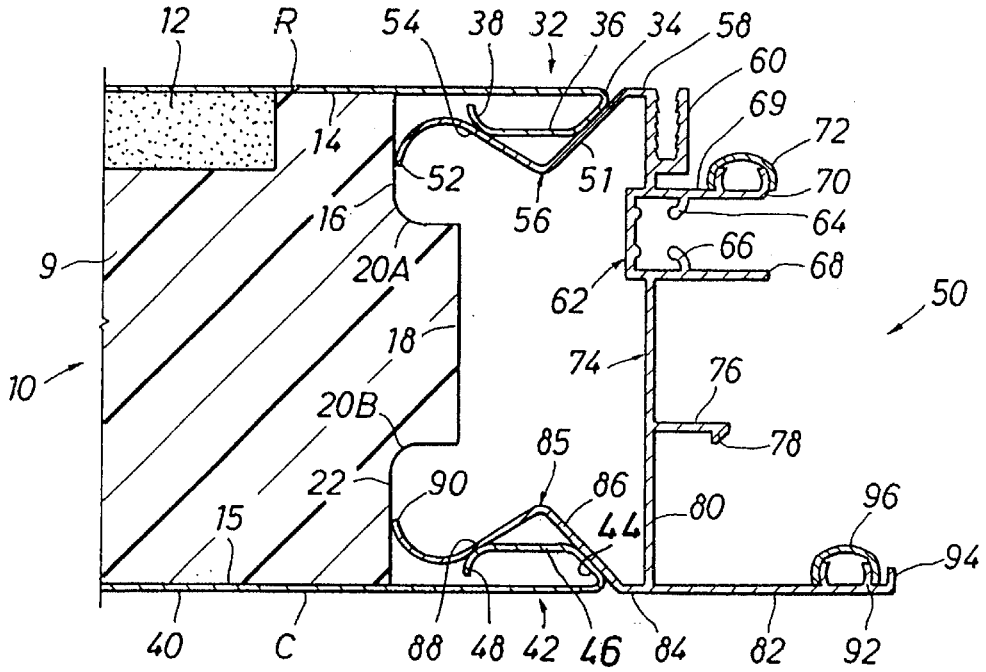
FIG. 2 is a cross-sectional view showing the interlock between male edge connectors of a panel and female edge connectors of a female skylight frame.

Referring now to FIG. 2, an enlarged cross-sectional view showing the interlock between a panel 10 and a female skylight frame 50 is disclosed. The panel member 10 has an interior insulated core 9 which can be constructed from any suitable preformed insulating material such as expanded polystyrene, urethane, polyisocyanurate, or the like. For example, a polystyrene core width with a thickness of 3" and a 1.5 lb. density constitutes one preferred core material. The core 9 can also be foamed-in-place material if so desired. The core 9 has a roof R having a generally rectangular groove or recess formed therein to enclose a generally rectangular plate or board shaped construction material member 12 in the groove which generally extends through the core 9 along the length of the panel. Above the top of the core 9 is a first thin-skinned member 30, which is a thin sheet of flexible metal, such as aluminum or steel. Preferably, aluminum panels having a thickness substantially in the range from 0.025" to 0.32" are used. Similarly, below the bottom of core 9 is a second thin-skinned member 40. The thin-skinned members 30 and 40 are generally rectangularly flat and tightly secured to the top 14 and bottom 15 of the core 9 by a suitable glue as known to persons of ordinary skill in the art. The core 9 further has an upper core side face 16 which gradually bends via corners 20A into a reduced thickness core side face 18. The reduced thickness core side face 18 gradually bends via corner 20B into a second core side face 22.

The first thin-skinned member 30 extends across the length of the panel and eventually is rolled into an upper male edge connector 32 having a first bend 34 where the thin-skinned member is rolled back into a flat portion 36 with an upwardly curled end portion 38. Similarly, the second thin-skinned member 40 is rolled into a lower male edge connector 42. The lower male edge connector 42 is bent backwardly at point 44 into a flat portion 46 with a downwardly curled end portion 48. The generally internally curved configuration of the male edge connectors 32 and 42 is formed utilizing a roll-forming machine as is known in the art.

Figure 4:
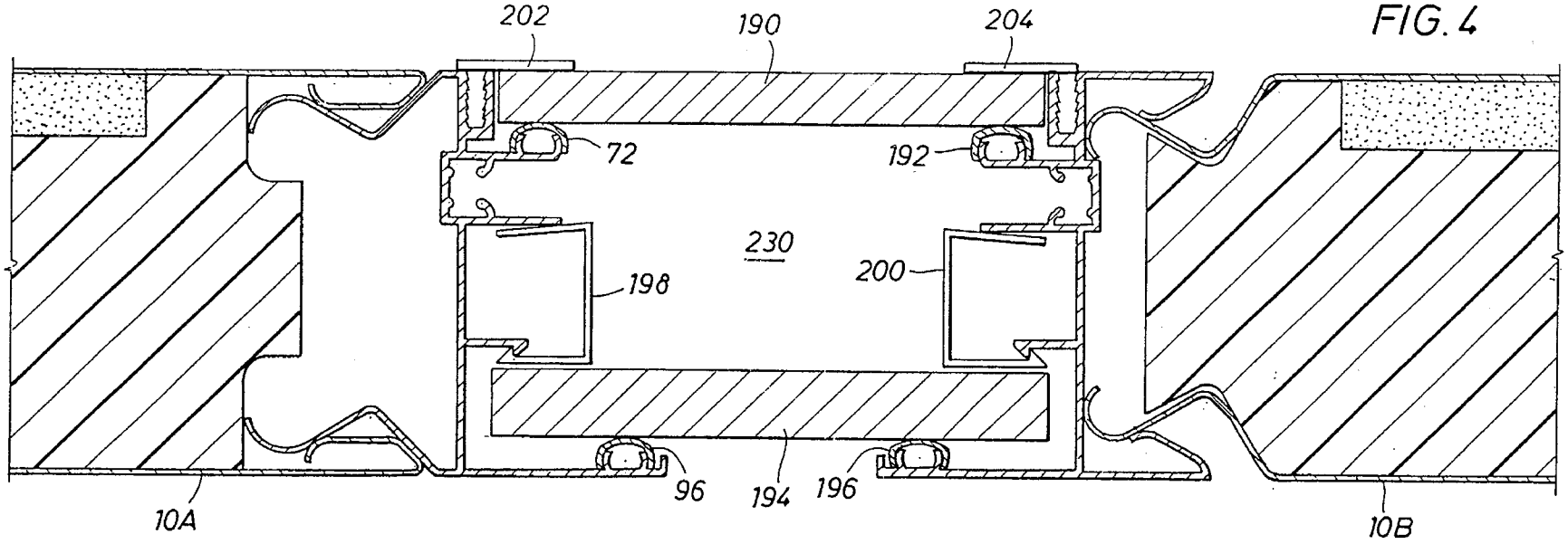
FIG. 4 is a cross-sectional view showing the interlock between the panels, the female skylight frame and the male skylight frame for suspending one or more radiation attenuating members.

The upper and lower male edge connectors 32 and 42 are adapted to receive connectors from a female skylight frame 50. The female skylight frame 50 has an upper female skylight connector 51. The upper female skylight connector 51 has a downwardly curled end portion 52 connected to a downwardly sloping surface 54. The downwardly sloping surface coupled with an upwardly sloping surface forms a generally V-shaped groove 56. The upper female skylight connector 51 is connected to an aligner 58 which properly spaces the connector from the frame. The aligner 58 is further connected to a first cap body 60 which eventually receives a cap to secure one of the radiation attenuation members. The first cap body 60 is connected to a thermal break pocket 62 which thermally isolates the upper part from the lower part of the frame. The thermal break pocket 62 has an upper pocket arm 69 and a lower pocket arm 68. A pair of first support fingers 70 rests on one end of the upper pocket arm 69. The pair of first support fingers 70 provides support for a radiation attenuating member, as shown in FIG. 4. A first gasket 72 slips over the pair of first support fingers 70 and provides a cushioning support between the first support fingers and the radiation attenuating member. The lower pocket arm 68 of the thermal break pocket 62 has an upper lip 64. The upper lip 64 is positioned on the lower side of the upper pocket arm 69 while a lower lip 66 is positioned on the upper side of the upper lower arm 68. The lips 64 and 66 are pointed toward each other and, in conjunction with the wall of the pocket 62, define a cubicle that can be filled with a thermal insolation material such as polyurethane. Once filled, the side wall of pocket 62 can be debridged to make a thermally broken extrusion.

The debridging of the thermal break pocket is well known in the art to thermally isolate the structure connected to lower pocket arm 68 from the structure connected to the upper pocket arm 69.

The lower pocket arm 68 is connected to a stand 74. The stand 74 has a middle skylight arm 76, which has a downwardly pointing notch 78 at one end. The downwardly pointing notch 78 is adapted to be coupled to a glazing cleat, shown in FIG. 4, to hold a radiation attenuating member securely in place. The stand 74 has further a lower stand 80 which is connected to a lower aligner 84 and a lower skylight arm 82. The lower aligner 84 is connected to a lower female skylight connector 85. The female skylight connector comprises a generally inverted V-shaped groove 86 having an upwardly surface and a downwardly surface. The downwardly sloping surface of the groove 86 is bent at point 88 before it is rolled into an upwardly curled end portion 90.

A pair of second support fingers 92 exists on the upper surface of the lower skylight arm or flange 82. A gutter arm 94 is attached to one end of the lower skylight arm 82 to define a longitudinal weeping path between the gutter arm 94 and one side of the second support fingers 92 for carrying moisture. The weeping path defined by gutter arm 94 and the pair of second support fingers 92 provides a drainage for condensation caused by the temperature difference between the environment and the interior of the skylight. The temperature changes can result in significant condensation of moisture under the surfaces of the radiation attenuating member. The thus formed weeping path collects moisture and carries it away.

During assembly, as the female skylight frame is pressed to the panel, the outside surface of the panel's male connector presses against the exterior surface of the internally curved or curled end portion of the frame's female connectors, causing the female connectors to temporarily move upwardly slightly like a spring so that the male connectors 32 and 42 may enter or slide into the V-shaped valley areas 56 and 86 of the upper and lower female skylight connectors 51 and 85. When the male connectors 32 and 42 are seated or nested in the V-shaped valleys or grooves 56 and 86 of the female skylight connectors, they are positioned as illustrated in FIG. 2.

One advantage of the connector configuration on the frame of the preferred embodiment is that the panel-frame combination may be taken apart by pulling the frame with respect to the other in virtually the same plane in which the panel and the frame were put together in the first place. This is a sharp contrast from the requirement that the panels be pulled apart by sliding them along their length, as is required by the prior art. Further, it is not necessary to use caulk or sealant with this design. This is particularly advantageous since caulks are not often uniformly applied in the field and also deteriorate over time, thus requiring more maintenance to prevent leaks.

In addition to leakage, a significant problem with prefabricated insulation panels is water condensation. Typically, when a cold rain falls, water can leak through the panel and rest on the upper surface of the bottom metallic skin 40 and the lower arm 82. Even though the cold rain water may not leak through, the cold water will reduce the temperature of the bottom panel skin 40 and lower arm 82 sufficiently to cause the moisture from the air within the room to condense on the underside of the bottom panel and skylight frame. This condensation may build up and actually drip on the floor and is thus undesirable.

A double gutter system is provided to eliminate water leakage at the connector junction as well as condensation at the ceiling. As shown in FIG. 2, the first gutter is a triangular cavity formed by the V-shaped valley 51. Water leakage collects within this triangular cavity which runs the length of the panel and flows outwardly to the end of the panel, thus eliminating any further intrusion of water into the connected panels under most circumstances. When the rainfall rate increases rapidly during a storm and exceeds the capacity of the triangular cavity 51 to drain off the rainfall, the water overflows up the internally curved portion 52 and flows or trickles downwardly between the core section faces and the female skylight frame 50. The overflowing water lands in the upper curved gutter recess formed by the curled end portion 90 and the upwardly sloping surface of groove 86 of the lower female edge connector 85. As can be seen in FIG. 2, the second gutter formed by the internally curved portion provides a second emergency gutter to take care of rain overflow situations.

To handle the problem of condensation, the metallic skin surfaces 40 and the upwardly curled end portion 90 define an elongated air pocket P extending the length of the panels. The air pocket P serves to insulate the core temperature or ice in the gutter and thereby preventing the temperature of the bottom metallic skin 40 from falling to the point that condensation is induced in the room.

Figure 3:
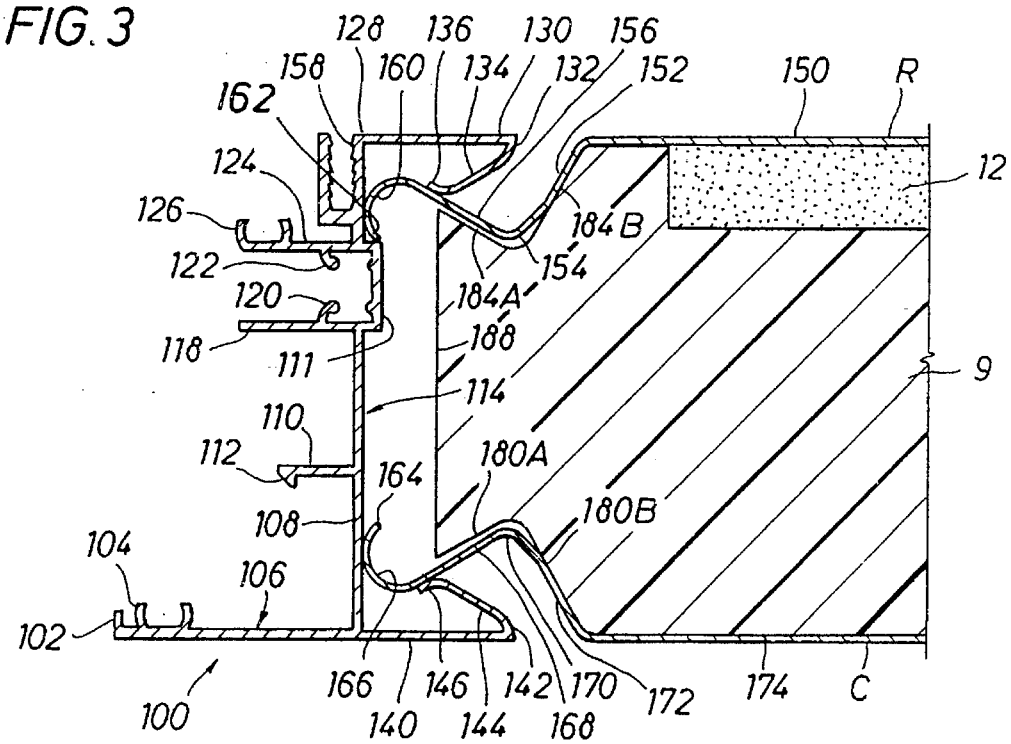
FIG. 3 is a cross-sectional view showing the interlock between female edge connectors of a second panel and male edge connectors of a male skylight frame.

Turning now to FIG. 3, a cross-sectional view showing the interlock between the male skylight frame 100 and the female connectors of panel 10 is disclosed. As shown in FIG. 3, the male skylight frame 100 comprises a second gutter arm 102 which in conjunction with a pair of fourth support fingers 104 defines another weeping path on the lower skylight arm 106. The lower skylight arm 106 is connected to a middle stand 108, which is connected to a middle skylight arm 110 having a downwardly pointing notch 112 at one end.

The middle stand 108 is also connected to a stand 114. A thermal break pocket is connected to the other end of the stand 114. A lower pocket arm 118 is connected to the bottom of the thermal break pocket, while an upper pocket arm 124 is connected to the top of the thermal break pocket 116. A pair of upper and lower lips 120 and 122 define the space for another polyurethane thermally broken extrusion, if so desired. A pair of third support fingers 126 is positioned on top of the upper pocket arm 124. Further, a second cap body 128 is connected to the top of the thermal break pocket 116. An upper male skylight connector 130 is connected to the body of the second cap. The upper male skylight connector 130 has a bend 132 connected to an angled portion 134 which ends at an upwardly curled end portion 136. Similarly, the lower skylight arm 106 is connected to a lower male skylight connector 140. The lower male skylight 140 has a bend 142 connected to an angled portion 144 which ends at a downwardly curled end portion 146.

The male skylight frame 100 is adapted to be received by the female connectors of panel 10. Similar to the panel in FIG. 2, the core 9 is positioned between a third thin-skinned member 150 and a fourth thin-skinned member 174. The third thin-skinned member 150 is rolled into a falling portion 156 and a rising portion 152 to define a V-shaped groove 154. The rising portion 152 bends at a point 158 to provide a curled end portion 162 having an interior surface 160. Similarly, the fourth thin-skinned member 174 has a rising portion 172 and a falling portion 168 to define an inverted V-shaped groove 170. The falling portion 168 is bent at a point 166 and terminates at a curled end portion 164.

The third and fourth thin-skinned members are secured to the top and bottom of the core 9. Core 9 has a side face 182 formed in conjunction with a V-shaped core groove or valley defined by sloping surfaces 180A, 180B, 184A, and 184B, respectively. The inclined surfaces 184A and 184B intersect to form the core V-shaped valley which runs the length of the panel 10. Similarly, the inclined surfaces 180A and 180B intersect to form the second core V-shaped valley. In this manner, the interior core side faces 180A, 180B, 184A, 184B, are positioned inside of the internal surfaces of the male connectors thereby minimizing exposure of the core surface to the possible damage during shipment and the like. Further, the angle of the bend of the female connector surfaces is inclined slightly less than the angle of incline of the core surfaces such that a V-shaped space is created between the female connectors and the V-shaped valleys of the core. This allows the female connector to flex inwardly when male skylight connectors 130 and 140 are inserted into the female connectors of the panel 10.

Referring to FIG. 4, the panels 10A–10B and the skylight frame members 50–100 are connected together in the following manner. As seen in FIG. 4, the panel member 10A and the skylight frame 50 are positioned adjacent to each other for connection by pressing or sliding the panel 10A with the female skylight frame 50 together while they are held generally in the same plane. Therefore, it is not necessary that the female skylight frame be held at an angle with respect to the panel 10A to snap them together. Similarly, the male skylight frame 100 and the panel member 10B are positioned adjacent to each other for connection by sliding them together while the panel and the frame are aligned in the same plane.

As the panels are pressed together, the inside curved surfaces of the male connectors press against the exterior surface of the internally curved or curled end portion of the female connectors, causing the female connectors to temporarily deflect inwardly or internally slightly like a spring so that the male connectors may enter or slide into the V-shaped valley areas of the female connectors. The internal deflection of the female connector members is desirable as the alternative of externally deflecting male connectors could push outwardly the flat portions of the metallic skins of the thin-skinned members and cause delamination of the core surfaces.

Once the panels and the frame members have been assembled, second and fourth gaskets 96 and 196 are inserted to cover their respective support fingers. The gaskets 96 and 196 may be constructed from a pre-molded butyl material and is adapted to engage with and securely fit with the support fingers. Each of the gaskets is generally C-shaped with a recess for covering the support fingers.

After the gaskets have been installed, a first radiation attenuating member 194 is placed on top of the gaskets 94 and 196. The first radiation attenuating member 194 typically is composed of acrylic, preferably a polycarbonate sheet manufactured by General Electric known as LEXAN or any twin-wall polycarbonate sheets. The radiation attenuating panel can also be a transparent panel to which a radiation attenuating film is applied, although the preferred embodiment is not limited to the use of such film. Alternatively, the radiation attenuating member can be made of a thermoplastic sheet as well as a tempered glass having low "E" solar control film or a similar element secured to the inner surface of the tempered glass. If the tempered glass and film combination is used, the film should be tinted so that the glare is reduced. Such material can also help to block at least a portion of the infrared and all of the ultraviolet rays. A primarily heat attenuating film is more desirable than the glare reducing film. The radiation attenuating member 194 may be constructed of, for example, a ¼" clear laminated safety glass or tempered glass. As used herein, "radiation attenuating" should be understood to refer any member which is designed for partially or fully blocking one or more of the glare, heat, infrared radiation, and ultraviolet radiation from the sun to an extent greater than is accomplished by conventional untreated glass.

To secure the first radiation attenuating member 194, a pair of glazing cleats 198 and 200 are provided. Each of glazing cleats 198 and 200 are positioned on top of the first radiation attenuating member 194 and can be pushed in the direction of the frame members until the end of each glazing cleat passes the downwardly pointing notch 78 to securely hold the attenuating member in position. Once engaged, the cleats form permanent locks to secure the attenuating member.

In many situations, a single layer of radiation attenuating member is sufficient to block the heat. However, in a number of southern locations, particularly in the Sun Belt, the sunlight may be so intense as to require a second attenuating member to further block the heat from passing through the skylight. To support a second attenuating member 190, a first and third gasket 72 and 192 are inserted over their respective support fingers. Next, the second radiation attenuating member 190 is placed on top of the gaskets 72 and 192. To safely secure the second radiation attenuating member 190 from being removed by turbulent air, a first cap and a second cap are tapped into the receptacles of the first and second cap bodies. The caps 202 and 204 have elongated clamps that prevent movement of the second radiation attenuating member 190 outside of its resting location. Thus, the arms of the skylight frame hold the first radiation attenuating member 194 and the second radiation attenuating member 190 in a generally parallel, spaced-apart relationship so that an interstitial air space 230 is formed between the panels. The interstitial air space 230 provides a thermal insulation layer which prevents heat which has passed through the second radiation attenuating member 190 from reaching the first radiation attenuating member 194. As a result of the multilayer of heat blocking schemes of the preferred embodiment, sunlight is allowed to pass through the skylight while heat, glare, and ultraviolet radiation are blocked out.

Figure 5:
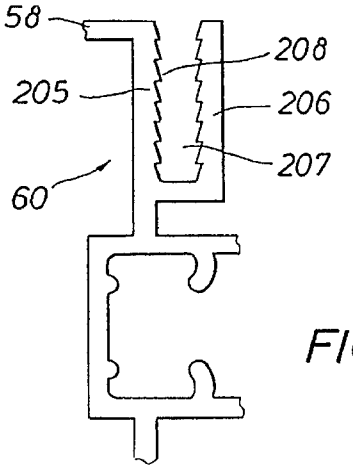
FIG. 5 is an enlarged cross-sectional view of a cap body of FIG. 4.

Turning now to FIG. 5, an enlarged cross-section of the first cap body 60 of FIG. 4 is illustrated. As shown in FIG. 5, the first cap body 60 has an enclosure 206. The cap enclosure 206 has a hollow core forming the cap receptacle 207. The cap receptacle has a plurality of downwardly pointing teeth 208, which as shown shortly below, form an unremovable lock with the first cap 202.

Figure 6:
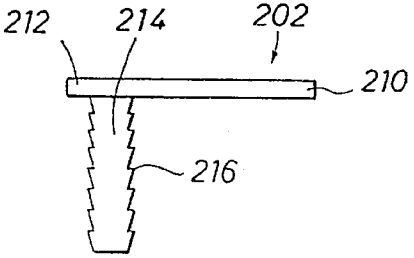
FIG. 6 is an enlarged cross-sectional view of a cap receptacle of FIG. 4.

Turning now to FIG. 6, a first cap 202 which operates in conjunction with the teeth of first cap body 60 to securely lock the second radiation attenuating member 190 in place is shown. The first cap 202 has an elongated clamp 210 connected to a shortened clamp 212. Elongated clamp 210 is further connected to a cap core 214 at a substantially perpendicular angle. The cap core 214 has a plurality of upwardly pointing teeth 216 which, upon insertion into the cap receptacle 207, provides a one-way entry into the cap receptacle. Thus, the upwardly pointing teeth 216 cooperate with the downwardly pointing teeth 208 to resist removal of the first cap 202 even by a violent force.

Figure 7:
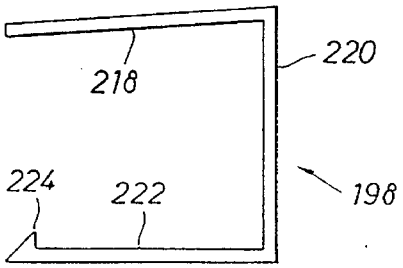
FIG. 7 is an enlarged side view of a glazing cleat of FIG. 4.

Turning to FIG. 7, the glazing cleat 198 of FIG. 4 is disclosed. As shown in FIG. 7, the glazing cleat 198 comprises an upper bar 218, a side bar 220, and a lower bar 222. The lower bar 222 is connected to a triangular latch 224 which cooperates with a downwardly pointing notch 78 to provide an interlocking mechanism. This interlocking mechanism is further buttressed by the supportive relationship between the upper bar 218 and the lower pocket arm 68. Further, because of the interlocking relationship of the latches, once inserted, the glazing cleat can never be removed.

As discussed above, the structure defined by the preferred embodiment represents an efficient approach to prevent leakage and condensation associated with skylights. Furthermore, the method of manufacturing such a skylight away from the job site and then installing in the same manner as an ordinary roofing panel represents a further advance over the prior art which requires specialized skilled labor on site. The skylight of the present invention is characterized by improved energy performance, thermal air and weather tightness, simplicity of installation, good weathering properties, and enhanced durability.

The foregoing disclosure and description of the invention are illustrative and explanatory thereof. Various changes in the details of the illustrated construction, the described method, or the materials used, can be made within the scope of the appended claims without departing from the true spirit of the invention.

What is claimed is:

1. A skylight panel for suspending a radiation attenuating member between a first longitudinally extending building panel and a second longitudinally extending building panel, said first and second longitudinally extending building panels adapted to be mounted substantially planar to each other and spaced apart, said first longitudinally extending building panel having an upper and a lower first panel connector projecting from a first side of said first longitudinally extending building panel, said second longitudinally extending building panel having an upper and a lower second panel connector extending from a second side of said second longitudinally extending building panel, said second panel connectors adapted to be directed toward the first side of said first longitudinally extending building panel, said skylight panel comprising:

a first longitudinally extending skylight frame adapted to be adjacently positioned to the first longitudinally extending building panel, said first longitudinally extending skylight frame including:

an upper and a lower first connector, said upper first connector proximally coupled to the top of said first longitudinally extending skylight frame, said lower first connector proximally coupled to the bottom of said first longitudinally extending skylight frame, said upper and lower first connectors adapted to be coupled to the upper and lower first panel connectors of the first longitudinally extending building panel; and a first lower flange mounted substantially perpendicularly to said first longitudinally extending skylight frame, said first lower flange having a first end proximally coupled to the bottom of said first longitudinally extending skylight frame and a second end extending away from said lower first connector;

a second longitudinally extending skylight frame adapted to be adjacently positioned to the second longitudinally extending building panel, said second longitudinally extending skylight frame including:

an upper and a lower second connector, said upper second connector proximally coupled to the top of said second longitudinally extending skylight frame, said lower second connector proximally coupled to the bottom of said second longitudinally extending skylight frame, said upper and lower second connectors adapted to be coupled to the upper and lower second panel connectors of the second longitudinally extending building panel; and a second lower flange mounted substantially perpendicularly to said second longitudinally extending skylight frame, said second lower flange having a first end proximally coupled to the bottom of said second longitudinally extending skylight frame and a second end extending toward said first lower flange, said first and second lower flanges adapted to support the radiation attenuating member;

a first middle flange coupled to said first longitudinally extending skylight frame and positioned above said first lower flange;

a second middle flange coupled to said second longitudinally extending skylight frame and positioned above said second lower flange;

a first cleat coupled to said first middle flange; and a second cleat coupled to said second middle flange, said first and second cleats adapted to secure said radiation attenuating member to the lower flanges.

2. The skylight panel of claim 1, further comprising:

a pair of first lower support fingers coupled to the second end of said first lower flange; and a pair of second lower support fingers coupled to the second end of said second lower flange, said first and second lower support fingers adapted to cushion said radiation attenuating member.

3. The skylight panel of claim 2 further comprising a plurality of gaskets, each of said gaskets being slipped over each of said lower support fingers and adapted to cushion said radiation attenuating member.

4. The skylight panel of claim 1 further comprising:

a first upper flange mounted substantially perpendicularly to said first longitudinally extending skylight frame, said first upper flange having a first end coupled to said first longitudinally extending skylight frame above said first lower flange and a second end extending away from said upper first connector; and a second upper flange mounted substantially perpendicularly to said second longitudinally extending skylight frame, said second upper flange having a first end coupled to said second longitudinally extending skylight frame above said second lower flange and a second end extending toward said first upper flange, said first and second upper flanges adapted to support a second radiation attenuating member.

5. The skylight panel of claim 4, further comprising a first cap receptacle proximally coupled to the top of said first longitudinally extending skylight frame a second cap receptacle proximally coupled to the top of said second longitudinally extending skylight frame; a first cap and a second cap respectively coupled to said first and second cap receptacles and adapted to secure said second radiation attenuating member to said first and second upper flanges.

6. The skylight panel of claim 5, wherein each of said cap receptacles has a plurality of downwardly pointing teeth and each of said caps has a plurality of upwardly pointing teeth, said downwardly pointing teeth of said cap receptacles adapted to prevent removal of said caps once said caps have been inserted.

7. The skylight panel of claim 4, further comprising:

a pair of first upper support fingers coupled to the second end of said first upper flange; and a pair of second upper support fingers coupled to the second end of said second upper flange, said first and second upper support fingers adapted to cushion said second radiation attenuating member.

8. The skylight panel of claim 7, further comprising a plurality of gaskets, each of said gaskets being slipped over each of said upper support fingers and adapted to cushion said radiation attenuating member.

9. The skylight panel of claim 1, wherein said first longitudinally extending skylight frame further comprises a first thermal break pocket positioned above said first lower flange and wherein said second longitudinally extending skylight frame further comprises a second thermal break pocket positioned above said second lower flange, said first and second thermal break pockets insulating said first and second lower flanges from the upper portions of said longitudinally extending skylight frames.

10. The skylight panel of claim 1, wherein each of said first and second longitudinally extending skylight frame is composed of aluminum.

11. The skylight panel of claim 1, wherein the radiation attenuating member is composed of acrylic.

12. The skylight panel of claim 1, wherein the radiation attenuating member is a polycarbonate sheet.

13. A skylight panel for suspending a first and second radiation attenuating member, said skylight panel comprising:

a first longitudinally extending building panel and a second longitudinally extending building panel, said first and second longitudinally extending building panel mounted substantially planar to each other and spaced apart, said first longitudinally extending building panel having an upper and a lower first panel connector projecting from a first side of said first longitudinally extending building panel, said second longitudinally extending building panel having an upper and a lower second panel connector extending from a second side of said second longitudinally extending building panel toward the first side of said first longitudinally extending building panel;

a first longitudinally extending skylight frame coupled to the first longitudinally extending building panel, said first longitudinally extending skylight frame including:

an upper and a lower first connector, said upper first connector proximally coupled to the top of said first longitudinally extending skylight frame, said lower first connector proximally coupled to the bottom of said first longitudinally extending skylight frame, said upper and lower first connectors coupled to the upper and lower first panel connectors of the first longitudinally extending building panel;

a first lower flange mounted substantially perpendicularly to said first longitudinally extending skylight frame, said first lower flange having a first end proximally coupled to the bottom of said first longitudinally extending skylight frame and a second end extending away from said lower first connector; and a first upper flange mounted substantially perpendicularly to said first longitudinally extending skylight frame, said first upper flange having a first end coupled to said first longitudinally extending skylight frame above said first lower flange and a second end extending away from said upper first connector; and a second longitudinally extending skylight frame coupled to the second longitudinally extending building panel, said second longitudinally extending skylight frame including:

an upper and a lower second connector, said upper second connector proximally coupled to the top of said second longitudinally extending skylight frame, said lower second connector proximally coupled to the bottom of said second longitudinally extending skylight frame, said upper and lower second connectors adapted to be coupled to the upper and lower second panel connectors of the second longitudinally extending building panel; and a second lower flange mounted substantially perpendicularly to said second longitudinally extending skylight frame, said second lower flange having a first end proximally coupled to the bottom of said second longitudinally extending skylight frame and a second end extending toward said first lower flange, said first and second lower flanges adapted to support the first radiation attenuating member; and a second upper flange mounted substantially perpendicularly to said second longitudinally extending skylight frame, said second upper flange having a first end coupled to said second longitudinally extending skylight frame above said second lower flange and a second end extending toward said first upper flange, said first and second upper flanges adapted to support the second radiation attenuating member;

a first middle flange coupled to said first longitudinally extending skylight frame and positioned above said first lower flange;

a second middle flange coupled to said second longitudinally extending skylight frame and positioned above said second lower flange;

a first cleat coupled to said first middle flange; and a second cleat coupled to said second middle flange, said first and second cleats adapted to secure said radiation attenuating member to the lower flanges.

14. The skylight panel of claim 13, further comprising a first cap receptacle proximally coupled to the top of said first longitudinally extending skylight frame, a second cap receptacle proximally coupled to the top of said second longitudinally extending skylight frame, a first cap and a second cap respectively coupled to said first and second cap receptacles and adapted to secure said second radiation attenuating member to said first and second upper flanges.

15. The skylight panel of claim 14, wherein each of said cap receptacles has a plurality of downwardly pointing teeth and each of said caps has a plurality of upwardly pointing teeth, said downwardly pointing teeth of said cap receptacles adapted to prevent removal of said caps once said caps have been inserted.

16. The skylight panel of claims 13, wherein said first longitudinally extending skylight frame further comprises a first thermal break pocket positioned above said first lower flange and wherein said Second longitudinally extending skylight frame further comprises a second thermal break pocket positioned above said second lower flange, said first and second thermal break pockets insulating said first and second lower flanges from the upper portions of said longitudinally extending skylight frames.

17. A skylight panel for suspending a radiation attenuating member between a first longitudinally extending building panel and a second longitudinally extending building panel, said first and second longitudinally extending building panel adapted to be mounted substantially planar to each other and spaced apart, said first longitudinally extending building panel having an upper and a lower first panel connector projecting from a first side of said first longitudinally extending building panel, said second longitudinally extending building panel having an upper and a lower second panel connector extending from a second side of said second longitudinally extending building panel, said second panel connectors adapted to be directed toward the first side of said first longitudinally extending building panel, said skylight panel comprising:

a first longitudinally extending skylight frame adapted to be adjacently positioned to the first longitudinally extending building panel, said first longitudinally extending skylight frame including:

an upper and a lower first connector, said upper first connector proximally coupled to the top of said first longitudinally extending skylight frame, said lower first connector proximally coupled to the bottom of said first longitudinally extending skylight frame, said upper and lower first connectors adapted to be coupled to the upper and lower first panel connectors of the first longitudinally extending building panel; and a first upper flange mounted substantially perpendicularly to said first longitudinally extending skylight frame, said first upper flange having a first end proximally coupled to the top of said first longitudinally extending skylight frame and a second end extending away from said upper first connector;

a second longitudinally extending skylight frame adapted to be adjacently positioned to the second longitudinally extending building panel, said second longitudinally extending skylight frame including:

an upper and a lower second connector, said upper second connector proximally coupled to the top of said second longitudinally extending skylight frame, said lower second connector proximally coupled to the bottom of said second longitudinally extending skylight frame, said upper and lower second connectors adapted to be coupled to the upper and lower second panel connectors of the second longitudinally extending building panel; and a second upper flange mounted substantially perpendicularly to said second longitudinally extending skylight frame, said second upper flange having a first end proximally coupled to the top of said second longitudinally extending skylight frame and a second end extending toward said first upper flange, said first and second upper flanges adapted to support the radiation attenuating member; and a first cap receptacle proximally coupled to the top of said first longitudinally extending skylight frame and a second cap receptacle proximally coupled to the top of said second longitudinally extending skylight frame, said first and second cap receptacles adapted to receive a first cap and a second cap for securing said radiation attenuating member to said first and second upper flanges.

18. The skylight panel of claim 17, wherein each of said cap receptacles has a plurality of downwardly pointing teeth and each of said caps has a plurality of upwardly pointing teeth, said downwardly pointing teeth of said cap receptacles adapted to prevent removal of said caps once said caps have been inserted.

19. The skylight panel of claim 17 further comprising:

a pair of first upper support fingers coupled to the second end of said first upper flange; and a pair of second upper support fingers coupled to the second end of said second upper flange, said first and second upper support fingers adapted to cushion said radiation attenuating member.

20. The skylight panel of claim 19, further comprising a plurality of gaskets, each of said gaskets being slipped over each of said upper support fingers and adapted to cushion said radiation attenuating member.

* * * * *